US005245927A

United States Patent [19]

Ranes

[11] Patent Number: 5,245,927

[45] Date of Patent: Sep. 21, 1993

[54] DUAL-TANDEM UNMANNED AIR VEHICLE SYSTEM

[75] Inventor: Richard L. Ranes, Simi Valley, Calif.

[73] Assignee: Northrop Corporation, Hawthorne, Calif.

[21] Appl. No.: 874,881

[22] Filed: Apr. 28, 1992

[51] Int. Cl.[5] ..... F42B 15/10

[52] U.S. Cl. ..... 102/378; 102/374; 102/489; 244/2

[58] Field of Search ..... 102/374, 377, 378, 476, 102/489; 244/2, 172

[56] References Cited

U.S. PATENT DOCUMENTS

| | | | |
|---|---|---|---|
| H867 | 1/1991 | Hill | 102/374 |
| 2,503,271 | 4/1950 | Hickman . | |
| 2,804,823 | 9/1957 | Jablansky . | |
| 2,898,856 | 8/1959 | Lighthody et al. | 102/374 |
| 3,115,836 | 12/1963 | Brashears | 102/377 |
| 3,199,406 | 8/1965 | Gould . | |
| 3,233,548 | 2/1966 | Chilowsky . | |
| 3,244,104 | 4/1966 | Mills et al. | 102/378 |
| 3,245,351 | 4/1966 | Crossett . | |
| 3,262,266 | 7/1966 | Howison . | |
| 3,310,947 | 3/1967 | Shryock . | |
| 3,427,047 | 2/1969 | Mayo | 102/378 |
| 3,437,285 | 4/1969 | Manfredi et al. | 244/172 |
| 3,439,613 | 4/1969 | Thomanek . | |
| 3,491,692 | 1/1970 | Blankenagel . | |
| 3,703,998 | 11/1972 | Girard | 244/2 |
| 3,760,730 | 9/1973 | Osborne et al. . | |
| 3,867,893 | 2/1975 | Saholt et al. | 102/489 |
| 4,244,294 | 1/1981 | Fregnac et al. | 102/374 |
| 4,342,252 | 8/1982 | Hagelberg et al. . | |
| 4,433,606 | 2/1984 | Hagelberg et al. . | |
| 4,522,356 | 6/1985 | Lair et al. | 102/489 |

FOREIGN PATENT DOCUMENTS

| | | | |
|---|---|---|---|
| 1506147 | 10/1970 | Fed. Rep. of Germany | 102/377 |
| 1273030 | 8/1961 | France | 102/374 |
| 1022635 | 3/1966 | United Kingdom | 102/378 |

*Primary Examiner*—Harold J. Tudor

*Attorney, Agent, or Firm*—Terry J. Anderson; Robert B. Block; Karl J. Hoch, Jr.

[57] ABSTRACT

An unmanned air vehicle system which is intended for launch from a platform such as an aircraft or a ship and to follow other than a ballistic trajectory includes a pair of substantially similar air vehicles in a tandem relationship. A unitary tubular airframe is provided coextensive with both air vehicles. The nose of a second air vehicle is nested in the tail member of a first air vehicle. A rocket booster is mounted in the tail of the second air vehicle and ignited for launch of both air vehicles as a unit. Thereafter, a pyrotechnic separating mechanism is actuated for bisecting the tubular airframe intermediate the tail member of the first air vehicle and the nose of the second air vehicle. Following separation, each air vehicle has a gas turbine engine which is ignited for powering its associated air vehicle to its destination. Electrical connections from the launch platform to the vehicle system are made to the first air vehicle and the second air vehicle is, in turn, electrically connected to the first.

11 Claims, 1 Drawing Sheet

DUAL-TANDEM UNMANNED AIR VEHICLE SYSTEM

BACKGROUND OF THE INVENTION

1. Field of the Invention

The present invention relates generally to an unmanned air vehicle system intended to follow other than a ballistic trajectory and, particularly, to such a system which utilizes substantially similar forward and aft air vehicles in a tandem relationship.

2. Description of the Prior Art

It has long been known to construct multi-stage ballistic missiles powered by either solid fuel or liquid fuel rocket engines with two or more stages connected in tandem. Usually, the engines for the different stages are operational in succession, that is, when the fuel of one stage is spent, that stage drops off and a successor unit is ignited. Typical of such constructions are U.S. Patents to Howison U.S. Pat. No. 3,262,266, to Crossett U.S. Pat. No. 3,245,351, to Shryock U.S. Pat. No. 3,310,947, and to Blankenagel U.S. Pat. No. 3,491.692.

In a number of instances, there is provision on a forward vehicle of such a tandem vehicle arrangement for guiding or deflecting exhaust gases laterally to avoid harm to an aft vehicle. The patents to Howison and Crossett, noted above, as well as to Chilosky U.S. Pat. No. 3,233,548, to Osborne et al. U.S. Pat. No. 3,760,730; and to Hickman U.S. Pat. No. 2,503,271 disclose various arrangements for achieving this goal.

It is also known to mount plural rockets in an elongated launch tube with associated guide and launch equipment for each rocket and to mount the launch tube, for example, beneath the wing of an attack aircraft or onboard a ship. Typical instances of tandem rocket launchers are found in U.S. Patents to Hagelberg et al. U.S. Pat. Nos. 4,342,252 and 4,433,606, and to Gould U.S. Pat. No. 3,199,406. Unfortunately, launch tubes add significantly to the weight and drag of the attack aircraft and, therefore, significantly reduce its performance. Nonetheless, it would not be desirable to discard the launch tubes following launch of their associated rockets because of their substantial replacement cost.

It has also been known to provide a multiple-unit projectile whose component units separate all the projectiles in flight, the following unit striking a target at a time delay interval after the leading unit strikes, whereby the maximum penetration and destructive effect of the successive impacts of the projectiles on the same spot or area of the target may be attained. The U.S. Pat. No. 2,804,823 to Jablansky is typical of such a known construction.

It was with knowledge of the prior art as just described that the present invention has been conceived and is now reduced to practice.

SUMMARY OF THE INVENTION

The present invention comprises an unmanned air vehicle system which is intended for launch from a platform such as an aircraft or a ship and to follow other than a ballistic trajectory. It includes a pair of substantially similar air vehicles in a tandem relationship. A unitary tubular airframe is provided coextensive with both air vehicles. The nose of a second air vehicle is nested in the tail member of a first air vehicle. A rocket booster is mounted in the tail of the second air vehicle and ignited for launch of both air vehicles as a unit. Thereafter, a pyrotechnic separating mechanism is actuated for bisecting the tubular airframe intermediate the tail member of the first air vehicle and the nose of the second air vehicle. Following separation, each air vehicle has a gas turbine engine which is ignited for powering its associated air vehicle to its destination. Electrical connections from the launch platform to the vehicle system are made to the first air vehicle and the second air vehicle is, in turn, electrically connected to the first.

The combined launch airframe can be configured for dimensional compatibility with common missiles such as the AIM-9 Sidewinder or the AIM-120 AMRAAM for the purpose of utilizing existing standard launch rails.

Furthermore, by combining two unmanned air vehicles in tandem, their aerodynamic drag contribution during external carriage on a manned aircraft is minimized.

Additionally, by combining two unmanned air vehicles into a single airframe, cost savings can be realized at the time of original manufacture and operations and support savings can also be achieved.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENTS

Figure 1:
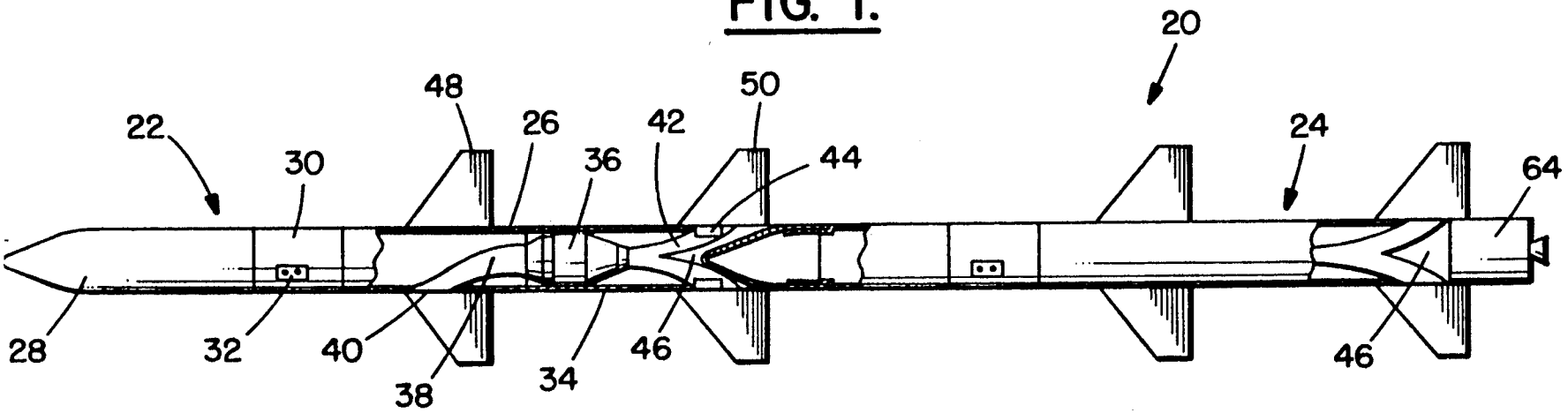
FIG. 1 is a side elevation view, certain parts being cut away for clarity, of an unmanned air vehicle system embodying the present invention.

Turn now to the drawings and, initially, to FIG. 1 which illustrates an unmanned air vehicle system 20 generally embodying the present invention. A primary purpose of the invention is to package a pair of unmanned air vehicles together to improve the prelaunch and launch geometry of the system. Thus, the system 20 includes a forward air vehicle 22 and an aft air vehicle 24 which mutually assume a tandem relationship having a common longitudinal axis. Consistent with this concept, in a preferred construction, the system 20 includes a unitary tubular air frame 26 which is coextensive with the forward and aft air vehicles 22, 24. The airframe 26 is preferably of circular and substantially constant cross section, but may be of a variety of other shapes without effectively altering the invention. In any event, the airframe 26 extends without interruption between a forward end of the system 20 (at the left, viewing FIG.

1) and an aft end of the system (at the right, viewing FIG. 1).

The forward and aft air vehicles 22, 24, respectively, are substantially identical. Therefore, a description of the forward air vehicle 22 which will now be presented can also be taken as a description of the aft air vehicle 24. In those instances in which differences do exist, they will be explained.

The forward air vehicle 22 includes a nose member 28 which is suitably mounted to the tubular air frame 26 as by welding, bonding, or by use of mechanical fasteners. In a typical arrangement, the nose member 28 carries the payload, whether that be instrumentation, ordinance, or other cargo, as desired. Immediately to the right of the nose member 28, viewing FIG. 1, in typical fashion, is a guidance and control section 30 which might include a suitable connector 32 for connecting the airborne instrumentation in the air vehicle 22 to that in the launch platform (not shown) which may be, for example, an aircraft or a ship.

To the right of the guidance and control section 30, as seen in FIG. 1, is a tail member 34 which contains a main propulsion system 36 of the air breathing variety, typically a gas turbine engine. An intake air duct 38 draws air to the propulsion system 36 from an inlet 40 which is flush with the outer peripheral surface of the air frame 26. In a similar manner, outlet air ducts 42 extend to outlets 44 which are similarly flush with the peripheral surface of the tubular air frame 26. The tail member 34 defines a rearward facing cavity 46 which is suitably shaped to receive, in a nesting relationship, the nose member of the aft air vehicle 24. It will be appreciated that the relationship between the nose member of the aft air vehicle 24 and that of the outlets 44 through which exhaust gases from the propulsion system 36 are directed is such as to assure that no damage occurs to the aft air vehicle 24 during operation of the propulsion system.

The forward air vehicle 22 is also provided with a set of suitable air foils 48, 50 which are operable in a known manner to provide both lift and control for the air vehicle.

Figure 3:
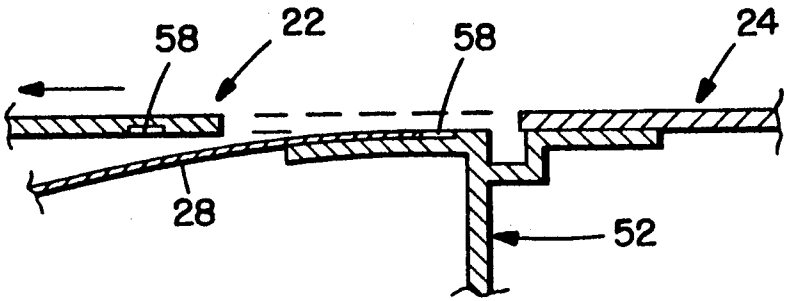
FIG. 3 is a detail cross section view, similar to FIG. 2, illustrating the interface between the forward and aft air vehicles immediately following separation.
Figure 2:
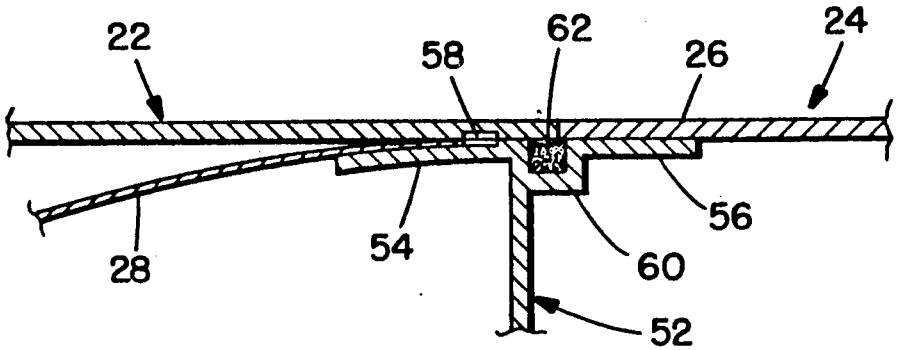
FIG. 2 is a detail cross section view generally illustrating the interface between forward and aft air vehicles comprising the air vehicle system, prior to separation.

The interface between the forward air vehicle 22 and the aft air vehicle 24 will now be described with particular attention to FIGS. 2 and 3. A T-shaped frame member 52 includes a forward extending (to the left in FIG. 1) flange 54 and an aft extending (to the right in FIG. 1) flange 56. The nose member 28 of the aft air vehicle 24 is suitably attached, as by welding, bonding, or by use of mechanical fasteners, to the forward flange 54 and the tubular air frame 26 is similarly attached to the aft flange 56. A pair of mating electrical connectors 58 (FIG. 2) on the forward air vehicle 22 and on the aft air vehicle 24 enable the interconnection of the airborne electrical system for the latter to be connected to that of the former. It was earlier explained that the forward air vehicle 22 has a connector 32 for electrical connection to the launch platform. In this manner, the system 20 is compatible with an existing launch platform without requiring any change to its electrical system or to its associated electrical connectors.

The frame member 52 is also provided with an annular channel member 60 for reception therein of a linear shaped charge 62. At an appropriate time, the shaped charge 62 is ignited to sever the tubular air frame 26 in the region of the rib member 52 such that, as seen in FIG. 3, the air vehicles 22, 24 are independent of each other and can proceed in separate trajectories.

The aft air vehicle 24, in contrast to the forward air vehicle 22, is provided with a booster propulsion unit 64 suitably mounted within its aft cavity 46. The booster propulsion unit 64 is typically a rocket motor.

The operation of the unmanned air vehicle system 20 will now be described. As the system 20 awaits launch on its platform, the airborne electrical system for the forward air vehicle 22 is connected, via connector 32, to that of the launching platform. In turn, by reason of the electrical connector 58 which has continuity with that of the connector 32, the airborne electrical system for the aft air vehicle 24 is likewise in communication with that of the launching platform. In a typical sequence of events, the booster propulsion unit 64 is ignited and the entire system 20 is released from the launching platform. The system 20 proceeds under the power of the booster propulsion unit 64 for a predetermined period of time at which point operation of the main propulsion systems 36 for each of the air vehicles 22, 24 is initiated. Again, after a predetermined period of time, the shaped charge 62 is ignited thereby separating the air vehicles 22, 24, each proceeding to its own destination. The booster propulsion unit 64 may remain with the aft air vehicle 24 for its entire mission. In the alternative, a suitable shaped charge, similar to the shaped charge 62, may be provided to separate the booster propulsion unit from the aft air vehicle.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An unmanned air vehicle system intended to be launched from an air-to-air missile launch station on an aircraft and to follow other than a ballistic trajectory comprising:

first and second substantially similar air vehicles, each including a central body section having a longitudinal axis, and being of substantially constant diameter extending from a streamlined nose section at a forward end thereof to a tail section at an aft end thereof, said tail section having a nesting cavity therein for receiving, in nesting relationship, said nose section of said second air vehicle such that said first and second air vehicles are positioned in a tandem relationship with their longitudinal axes aligned;

each of said vehicles including airfoils mounted on and extending outwardly from the respective main body section for providing both lift and control;

booster rocket means mounted on said aft end of said second air vehicle for initiating free flight of said first and second air vehicles as a unit;

separation means selectively operable for separating said first and second air vehicles after free flight has been initiated; and first and second main propulsion means for independently propelling said first and second air vehicles, respectively, after operation of said separation means.

2. An unmanned air vehicle system as set forth in claim 1 wherein each of said first and second main propulsion means is a gas turbine engine.

3. An unmanned air vehicle system as set forth in claim 1 including guide means for directing the flow of exhaust gases from said first and second main propulsion means rearwardly and away from said nesting cavity.

4. An unmanned air vehicle system as set forth in claim 1 further including release means for releasing said booster propulsion means from said aft end of said second air vehicle after a predetermined period of time.

5. An unmanned air vehicle system intended to follow other than a ballistic trajectory comprising:

first and second substantially similar air vehicles in a tandem relationship;

a unitary tubular airframe coextensive with said first and second air vehicles extending between a forward end and an aft end;

said first air vehicle including a first nose member mounted to said tubular airframe adjacent said forward end and a first tail member defining a rearward facing first cavity intermediate said forward end and said aft end;

a first set of airfoils mounted on and extending outwardly from said tubular airframe and associated with said first air vehicle for providing both lift and control thereof;

said second air vehicle including a second nose member mounted to said tubular airframe adjacent said first trail member and received in nesting relationship with the first cavity and a second tail member being said aft end of said tubular member defining a rearward facing second cavity;

a second set of airfoils mounted on and extending outwardly from said tubular airframe and associated with said second air vehicle for providing both lift and control thereof;

booster rocket means mounted on said second tail member for initiating free flight of said first and second air vehicles as a unit;

separation means selectively operable for separating said first and second air vehicles after free flight has been initiates;

first and second main propulsion means for independently propelling said first and second air vehicles, respectively, after operation of said separation means.

6. An unmanned air vehicle system as set forth in claim 5 wherein each of said first and second main propulsion means is a gas turbine engine.

7. An unmanned air vehicle system as set forth in claim 5 including: release means for releasing said booster propulsion means from said second tail member after a predetermined period of time.

8. An unmanned air vehicle system as set forth in claim 5 including:

first guide means associated with said first air vehicle for directing the flow of exhaust gases from said first main propulsion means therefor rearwardly and away from the first cavity; and second guide means associated with said second air vehicle for directing the flow of exhaust gases from said second main propulsion means therefor rearwardly and away from the second cavity.

9. An unmanned air vehicle system as set forth in claim 5 wherein said tubular airframe has a longitudinal axis; and wherein said tubular airframe has a transverse dimension which is substantially constant between said forward end and said aft end.

10. An unmanned air vehicle system as set forth in claim 5 wherein said separation means includes a peripherally extending weakened region in said tubular airframe intermediate said first tail member and said second nose member; and pyrotechnic means attached to said weakened region selectively operable for abruptly bisecting said tubular airframe into a first airframe member associated with said first air vehicle and a second airframe member associated with said second air vehicle.

11. An unmanned air vehicle system as set forth in claim 5 wherein said first air vehicle has first airborne electrical system;

wherein said second air vehicle has a second airborne electrical system;

wherein said first nose member includes electrical connection means for connecting said first airborne electrical system to the electrical system of a launching platform; and wherein said second nose member includes electrical connection means for connecting said second airborne electrical system to said first airborne electrical system.

* * * * *